US005782407A

United States Patent [19]

VanDegrift

[11] Patent Number: 5,782,407

[45] Date of Patent: Jul. 21, 1998

[54] MULTIPLE-PERSON WATER DRINKING FOUNTAIN SYSTEM

[76] Inventor: Tyre A. VanDegrift, 8746 Sun Country Dr., Elizabeth, Colo. 80107

[21] Appl. No.: 754,787

[22] Filed: Nov. 21, 1996

[51] Int. Cl.[6] ..... B05B 1/20; B05B 15/06

[52] U.S. Cl. ..... 239/24; 239/273; 239/279

[58] Field of Search ..... 239/24, 16, 25, 239/279, 273; 4/567, 568, 569, 570, 591, 601, 615, 620, 624, 900; D7/304

[56] References Cited

U.S. PATENT DOCUMENTS

| | | | |
|---|---|---|---|
| 972,589 | 10/1910 | Winters | 4/569 |
| 3,047,241 | 7/1962 | McLhinney | 239/273 |
| 3,170,171 | 2/1965 | Mayhew et al. | 4/615 |
| 4,264,036 | 4/1981 | Moore | 239/32 |
| 4,298,166 | 11/1981 | White et al. | 239/24 |
| 4,778,108 | 10/1988 | Richards | 239/26 |
| 4,934,597 | 6/1990 | Crutcher | 239/27 |
| 4,991,775 | 2/1991 | Huber et al. | 239/25 |
| 5,121,882 | 6/1992 | Skidmore | 239/273 X |
| 5,161,569 | 11/1992 | Chao-I | 137/448 |

*Primary Examiner*—Lesley D. Morris
*Assistant Examiner*—David Deal

[57] ABSTRACT

A new Multiple-Person Water Drinking Fountain System for supplying water to a large number of people simultaneously from a single water hose. The inventive device includes a U-shaped tube secured to a base, where both ends of the U-shaped tube are closed, a water supply valve connected into a lower portion of the U-shaped tube for coupling to a garden hose, and a plurality of apertures into the U-shaped tube. In an alternative embodiment, a water conservation valve is positioned into the U-shaped tube concentrically for allowing selective termination of a portion of the apertures.

6 Claims, 2 Drawing Sheets

MULTIPLE-PERSON WATER DRINKING FOUNTAIN SYSTEM

BACKGROUND OF THE INVENTION

1. Field of the Invention

The present invention relates to Drinking Fountain Devices and more particularly pertains to a new Multiple-Person Water Drinking Fountain System for supplying water to a large number of people simultaneously from a single water hose.

2. Description of the Prior Art

The use of Drinking Fountain Devices is known in the prior art. More specifically, Drinking Fountain Devices heretofore devised and utilized are known to consist basically of familiar, expected and obvious structural configurations, notwithstanding the myriad of designs encompassed by the crowded prior art which have been developed for the fullfilment of countless objectives and requirements.

Known prior art Drinking Fountain Devices include U.S. Pat. No. 4,298,166; U.S. Pat. No. 4,264,036; U.S. Pat. No. 5,161,569; U.S. Pat. No. 4,991,775; U.S. Pat. No. 4,934,597 and U.S. Pat. No. 4,778,108.

While these devices fulfill their respective, particular objectives and requirements, the aforementioned patents do not disclose a new Multiple-Person Water Drinking Fountain System. The inventive device includes a U-shaped tube secured to a base, where both ends of the U-shaped tube are closed, a water supply valve connected into a lower portion of the U-shaped tube for coupling to a garden hose, and a plurality of apertures into the U-shaped tube.

In these respects, the Multiple-Person Water Drinking Fountain System according to the present invention substantially departs from the conventional concepts and designs of the prior art, and in so doing provides an apparatus primarily developed for the purpose of supplying water to a large number of people simultaneously from a single water hose.

SUMMARY OF THE INVENTION

In view of the foregoing disadvantages inherent in the known types of Drinking Fountain Devices now present in the prior art, the present invention provides a new Multiple-Person Water Drinking Fountain System construction wherein the same can be utilized for supplying water to a large number of people simultaneously from a single water hose.

The general purpose of the present invention, which will be described subsequently in greater detail, is to provide a new Multiple-Person Water Drinking Fountain System apparatus and method which has many of the advantages of the Drinking Fountain Devices mentioned heretofore and many novel features that result in a new Multiple-Person Water Drinking Fountain System which is not anticipated, rendered obvious, suggested, or even implied by any of the prior art Drinking Fountain Devices, either alone or in any combination thereof.

To attain this, the present invention generally comprises a U-shaped tube secured to a base, where both ends of the U-shaped tube are closed, a water supply valve connected into a lower portion of the U-shaped tube for coupling to a garden hose, and a plurality of apertures into the U-shaped tube.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Multiple-Person Water Drinking Fountain System apparatus and method which has many of the advantages of the Drinking Fountain Devices mentioned heretofore and many novel features that result in a new Multiple-Person Water Drinking Fountain System which is not anticipated, rendered obvious, suggested, or even implied by any of the prior art Drinking Fountain Devices, either alone or in any combination thereof.

It is another object of the present invention to provide a new Multiple-Person Water Drinking Fountain System which may be easily and efficiently manufactured and marketed.

It is a further object of the present invention to provide a new Multiple-Person Water Drinking Fountain System which is of a durable and reliable construction.

An even further object of the present invention is to provide a new Multiple-Person Water Drinking Fountain System which is susceptible of a low cost of manufacture with regard to both materials and labor, and which accordingly is then susceptible of low prices of sale to the consuming public, thereby making such Multiple-Person Water Drinking Fountain System economically available to the buying public.

Still yet another object of the present invention is to provide a new Multiple-Person Water Drinking Fountain System which provides in the apparatuses and methods of the prior art some of the advantages thereof, while simultaneously overcoming some of the disadvantages normally associated therewith.

Still another object of the present invention is to provide a new Multiple-Person Water Drinking Fountain System for supplying water to a large number of people simultaneously from a single water hose.

Yet another object of the present invention is to provide a new Multiple-Person Water Drinking Fountain System which includes a U-shaped tube secured to a base, where both ends of the U-shaped tube are closed, a water supply valve connected into a lower portion of the U-shaped tube for coupling to a garden hose, and a plurality of apertures into the U-shaped tube.

Still yet another object of the present invention is to provide a new Multiple-Person Water Drinking Fountain System that can be coupled to a single water source and emit a plurality of water streams for drinking by a plurality of individuals.

Even still another object of the present invention is to provide a new Multiple-Person Water Drinking Fountain System that conserves water by allowing the users to turn of a water conservation valve to turn off a portion of the apertures.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof Such description makes reference to the annexed drawings wherein.

DESCRIPTION OF THE PREFERRED EMBODIMENT

Figure 2:
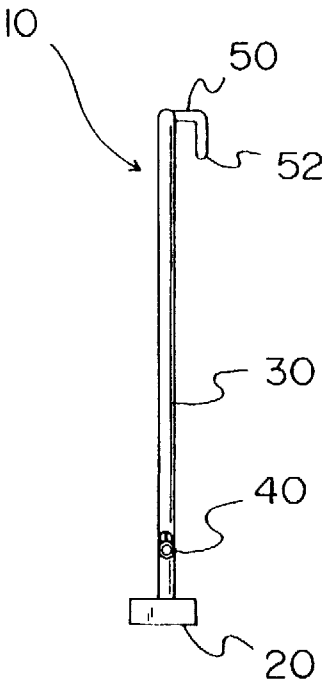
FIG. 2 is an end view of the present invention.

With reference now to the drawings, and in particular to FIGS. 1 through 4 thereof, a new Multiple-Person Water Drinking Fountain System embodying the principles and concepts of the present invention and generally designated by the reference numeral 10 will be described.

Figure 1:
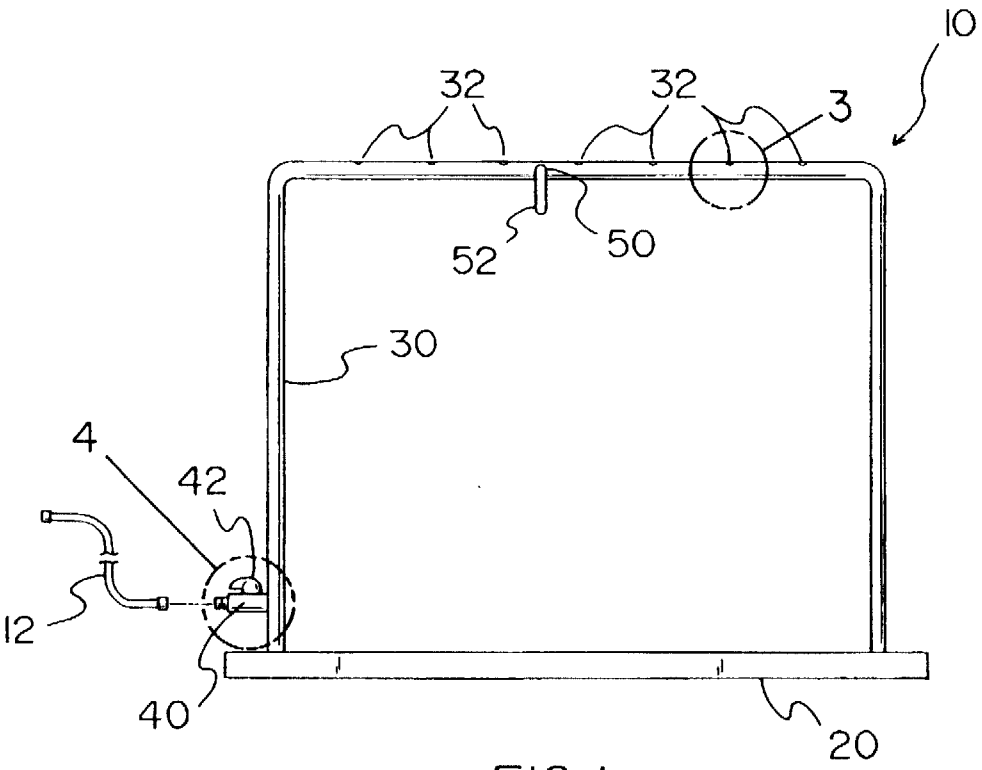
FIG. 1 is a front view of a new Multiple-Person Water Drinking Fountain System according to the present invention.
Figure 3:
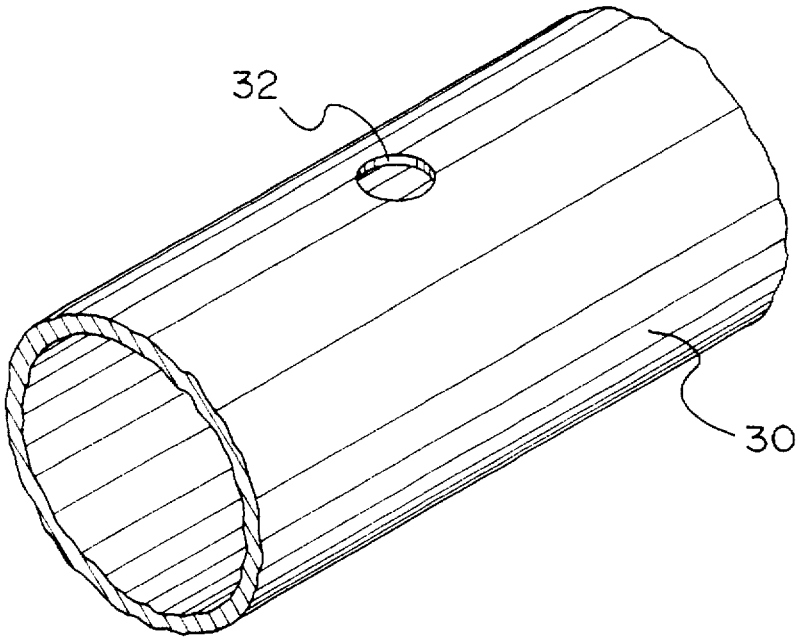
FIG. 3 is a magnified upper perspective view from FIG. 1 disclosing an aperture.

More specifically, it will be noted that the Multiple-Person Water Drinking Fountain System 10 comprises a base 20, a U-shaped tube 30 having a pair of closed ends opposite of an upper portion, the U-shaped tube 30 including a plurality of apertures 32 along the upper portion spaced apart, and a means connected near one the closed end for connecting to a garden hose 12. The closed ends are secured to the base 20 as shown in FIGS. 1 and 2 of the drawings with the U-shaped tube 30 orthogonal to the base 20. The means is for supplying water into the U-shaped tube 30 where the water radiates out through the apertures 32 allowing a plurality of individuals to drink the radiating water.

Figure 4:
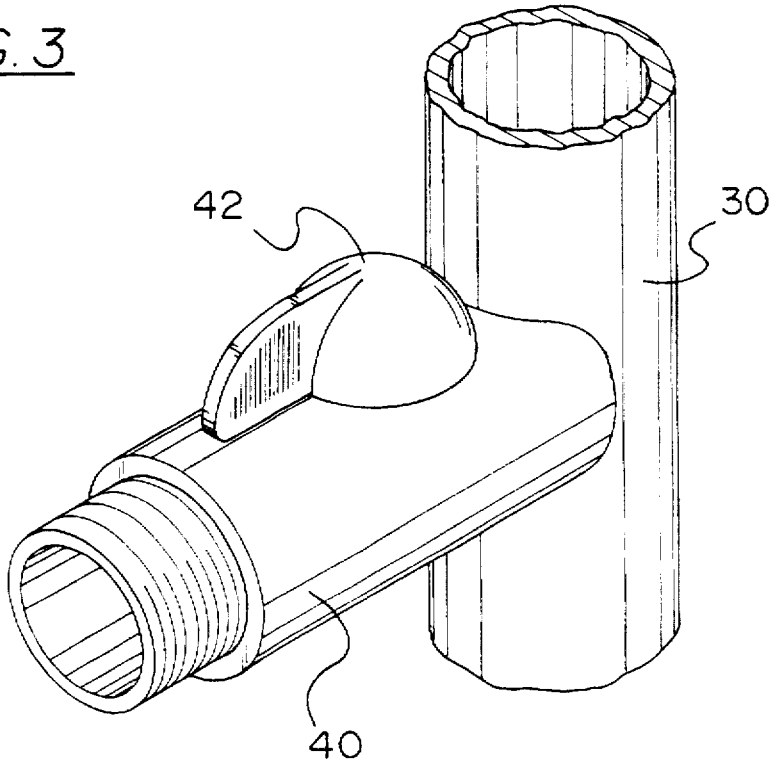
FIG. 4 is a magnified upper perspective view from FIG. 1 disclosing the water supply valve.

As shown in FIGS. 1, 2 and 4, the means comprises a water supply valve 40 having a half-winged handle 42 for selectively controlling the amount of water flowing out of the apertures 32. The apertures 32 are preferably evenly spaced thereby providing a uniform and consistent water path for the individuals.

In an alternative embodiment as shown in FIGS. 1 and 2, a water conservation valve 50 is connected concentrically within the upper portion of the U-shaped tube 30. The water conservation valve 50 allows selective control over a portion of the apertures 32 following the water conservation valve 50. The water conservation valve 50 also has an elongated handle 52 for easy utilization.

In use, the garden hose 12 is matingly coupled to the water supply valve 40. The water supply valve 40 is opened allowing water from the garden hose 12 to flow through into the U-shaped tube 30. The water thereafter flows out of the U-shaped tube 30 through the apertures 32 into the upper portion of the U-shaped tube 30. The user can adjust the water supply valve 40 to control the pressure and amount of water coming out of the apertures 32. Also, in the alternative embodiment, the user can close a portion of the apertures 32 by manipulating the water conservation valve 50 positioned concentrically within the U-shaped tube 30. This allows the user to conserve water while simultaneously having the capabilities of doubling the number of individuals that can drink when there is a high demand.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A Multiple-Person Water Drinking Fountain System comprising:

a base;

a U-shaped tube having a pair of closed ends opposite of an upper portion;

said closed ends secured to said base;

said U-shaped tube including a plurality of apertures along said upper portion spaced apart; and a means connected near one said closed end for connecting to a garden hose, for supplying water into said U-shaped tube where said water radiates out through said apertures allowing a plurality of individuals to drink the radiating water.

2. The Multiple-Person Water Drinking Fountain System of claim 1, wherein said means comprises a water supply valve having a half-winged handle for selectively controlling the amount of water flowing out of said apertures.

3. The Multiple-Person Water Drinking Fountain System of claim 2, wherein said apertures are evenly spaced providing a uniform and consistent water path for said individuals.

4. The Multiple-Person Water Drinking Fountain System of claim 3, including a water conservation valve connected concentrically within said upper portion of said U-shaped tube, for allowing selective control over a portion of said apertures following said water conservation valve.

5. The Multiple-Person Water Drinking Fountain System of claim 4, wherein said water conservation valve includes an elongated handle for easy utilization.

6. The Multiple-Person Water Drinking Fountain System of claim 5, wherein said U-shaped tube is orthogonal to said base.

* * * * *